US005687982A

United States Patent [19]

Challande et al.

[11] Patent Number: 5,687,982

[45] Date of Patent: Nov. 18, 1997

[54] ELEMENT AND ASSEMBLY FOR RETAINING A BOOT ON A GLIDING BOARD

[75] Inventors: Christian Challande, Cruseilles; Pierre Desarmaux, Evires, both of France

[73] Assignee: Salomon S.A., Metz-Tessy, France

[21] Appl. No.: 411,317

[22] Filed: Mar. 28, 1995

[30] Foreign Application Priority Data

Mar. 30, 1994 [FR] France ..... 94 04051

[51] Int. Cl.[6] ..... A63C 9/08

[52] U.S. Cl. ..... 280/607; 280/625; 280/634

[58] Field of Search ..... 280/634, 636, 280/631, 628, 607, 602, 11.14, 625

[56] References Cited

U.S. PATENT DOCUMENTS

| | | | |
|---|---|---|---|
| 4,336,956 | 6/1982 | Richert et al. | 280/625 |
| 4,372,574 | 2/1983 | Svoboda et al. | 280/634 |
| 4,538,828 | 9/1985 | Dimier | 280/628 |
| 5,044,658 | 9/1991 | Challande et al. | 280/631 |
| 5,222,756 | 6/1993 | Gorza | 280/634 |
| 5,380,032 | 1/1995 | Challande | 280/634 |
| 5,397,149 | 3/1995 | Couderc et al. | 280/602 |
| 5,540,458 | 7/1996 | Arduin et al. | 280/634 |

FOREIGN PATENT DOCUMENTS

| | | | |
|---|---|---|---|
| 0556610 | 8/1993 | European Pat. Off. | A63C 9/00 |
| 0567780 | 11/1993 | European Pat. Off. | A63C 9/00 |
| 2625687 | 7/1989 | France | 280/634 |
| 2640516 | 6/1990 | France | A63C 9/08 |
| 2688144 | 9/1993 | France | A63C 9/00 |
| 2905837 | 8/1980 | Germany | 280/634 |
| WO93/11838 | 6/1993 | WIPO | A63C 9/00 |
| WO93/15797 | 8/1993 | WIPO | A63C 9/00 |

*Primary Examiner*—Anne Marie Boehler

*Attorney, Agent, or Firm*—Greenblum & Bernstein, P.L.C.

[57] ABSTRACT

The invention is related to a retention element for a boot on a gliding board, especially an alpine ski, including a retention jaw, a body bearing the jaw, a jaw return mechanism including a return spring acting on a latching member so as to provide an elastic resistance force against the spacing of the jaw from its retention position, a mobile sensor adapted to at least locally support the sole of the boot, a connection between the sensor and the return mechanism. The connection is provided to increase the elastic resistance force that the return mechanism exerts on the jaw in response to an increase in the support force perceived by the sensor.

10 Claims, 8 Drawing Sheets

ELEMENT AND ASSEMBLY FOR RETAINING A BOOT ON A GLIDING BOARD

BACKGROUND OF THE INVENTION

1. Field of the Invention

The invention is related to an element for retaining a boot on a gliding board, especially on an alpine ski. The invention is also related to an assembly for retaining a boot on a gliding board, especially an alpine ski. Secondly, the invention is related to a binding assembly adapted to retain a boot in support on a ski.

2. Discussion of Background and Material Information

In the case of an alpine ski, holding a boot in support by a front retention element and a rear retention element, that respectively maintain the front and rear ends of the boot, is already known.

Each retention element generally has a jaw borne by a body, the body being connected to the ski by a base. The jaw is movable between a position wherein it retains the boot, and a position wherein it allows the boot to become released. An elastic return mechanism, generally constituted by a compression spring, supplies a resistance force to the displacement of the jaw.

The resistance force is determined by the stiffness of the spring, as well as by an adjustment means, usually a screw or a threaded nut, that enables the initial compression of the spring to be adjusted. The adjustment means normally enables the stiffness of the binding element to be adjusted, on a hardness scale that is defined by the nature of the spring. This stiffness is indicative of the force that the boot must overcome in order to be released. During skiing, this force is only influenced by the friction of the boot in its retention jaw.

German Patent Publication No. 2,916,352 discloses a return mechanism that comprises, in parallel, a spring and a shock absorption member that increasingly resists the compression of the spring as the force at the opening of the jaw becomes greater.

Such a mechanism permits an increase in the force that the jaw must overcome in order to release the boot depending upon the speed at which the boot biases the jaw at opening. Thus at low speeds, corresponding generally to situations where the skier is at a stop or is skiing slowly, the force to be overcome is relatively low. Conversely, if the skier skis more quickly, his or her boot biases the jaw more significantly and the jaw puts forth a greater resistance at opening.

This construction is delicate to implement because the shock absorption member, which must not be cumbersome, must be controlled, as must the flow of the liquid inside such member. In addition, in order to obtain a reliable effect, the fluidity of the liquid must not be too sensitive to temperature variations.

SUMMARY OF THE INVENTION

The problem set forth by the invention is to improve the operation of existing binding or retention elements.

The invention proposes adapting the stiffness of the binding element to the conditions of use of the binding element while skiing.

In fact, an object is to obtain an effect of the same type as the one obtained with German Patent Publication No. 2,916,352, but by other means, basing the increase of the return force of the jaw on a different source of information.

Another object of the invention is to propose a retention element whose jaw return force is not influenced by the outside temperature.

Another object of the invention is to propose a retention element that is relatively simple to construct.

Another object of the invention is to propose a binding assembly that has an effect on the distribution of pressure of the ski on the snow.

These objects and other objects that will become apparent from the description that follows are achieved by the invention.

Compensation mechanisms using a sensor located beneath the boot, such sensor acting on the return mechanism of the jaw, are known. Such a device is described, for example, in German Patent Publication No. 3,307,022.

However, the effect of these mechanisms is contrary to the one desired by the present invention. Indeed, these mechanisms decrease the return force that the jaw must overcome in order to release the boot, so as to compensate for the increase in friction between the boot and the jaw. As will become apparent from the description that follows, the invention is not incompatible with such mechanisms.

BRIEF DESCRIPTION OF THE DRAWINGS

The invention will be better understood with reference to the description that follows hereinafter and with reference to the annexed drawings that form an integral part thereof.

DETAILED DESCRIPTION OF THE PREFERRED EMBODIMENTS

Figure 1:
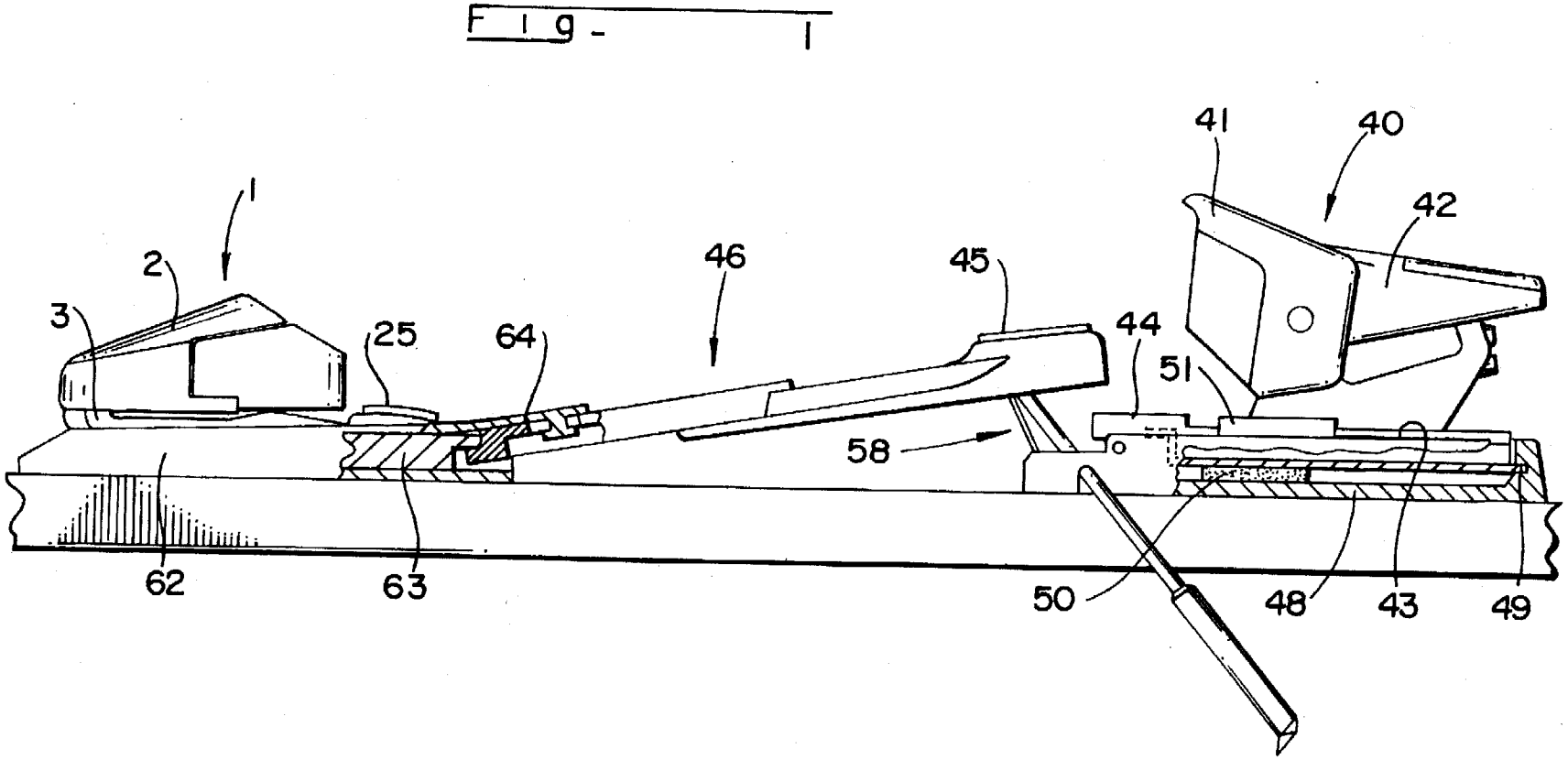
FIG. 1 is a side elevation view of a binding assembly putting the invention in practice.
Figure 2:
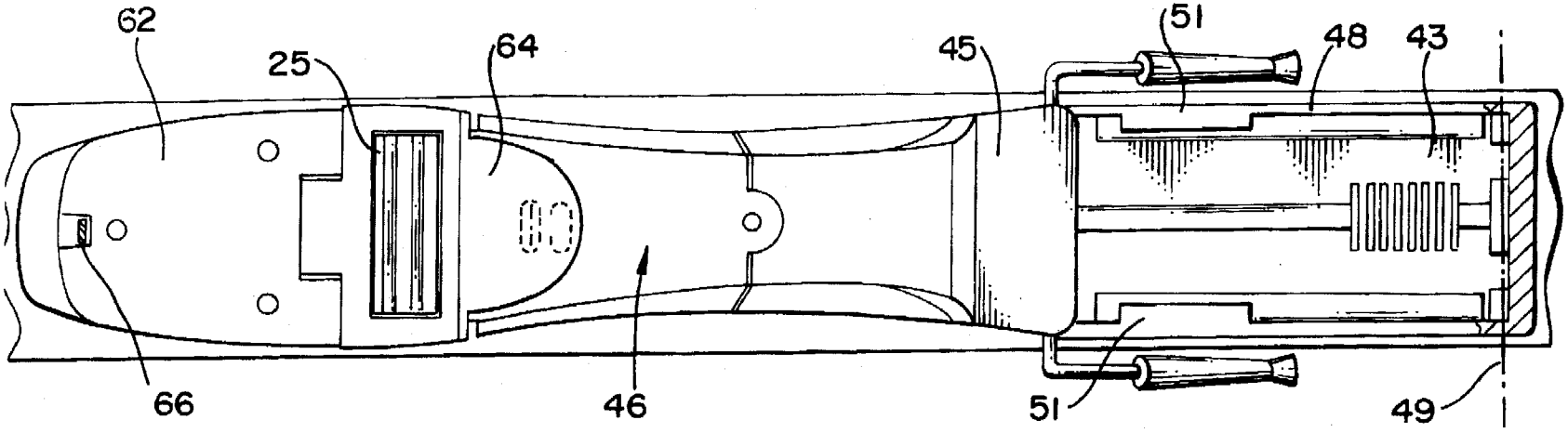
FIG. 2 is a partial top plan view of the assembly of FIG. 1.
Figure 7:
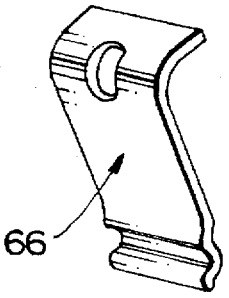
FIG. 7 is a front view of a component of the binding element represented in FIG. 3.
Figure 3:
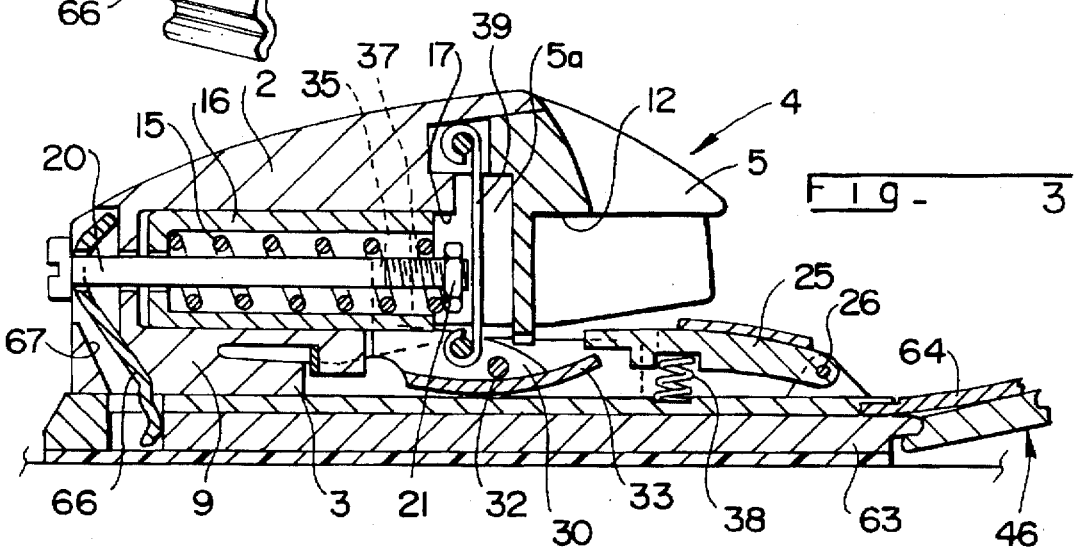
FIG. 3 is a sectional side elevation view of the front binding element of FIG. 1.
Figure 4:
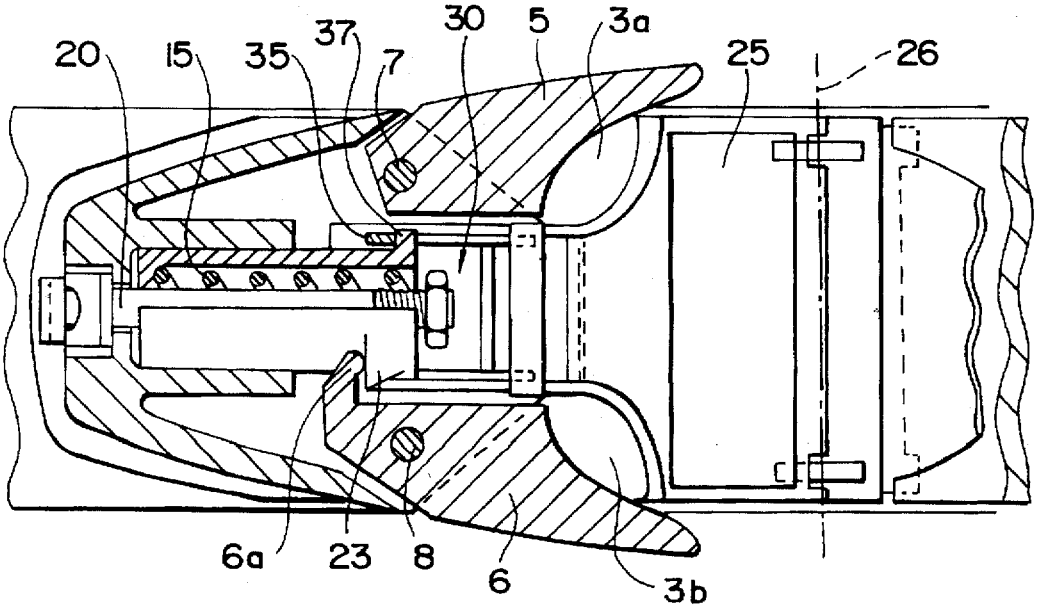
FIG. 4 represents a top plan view, in two half sections along different planes, the binding element of FIG. 3.
Figure 5:
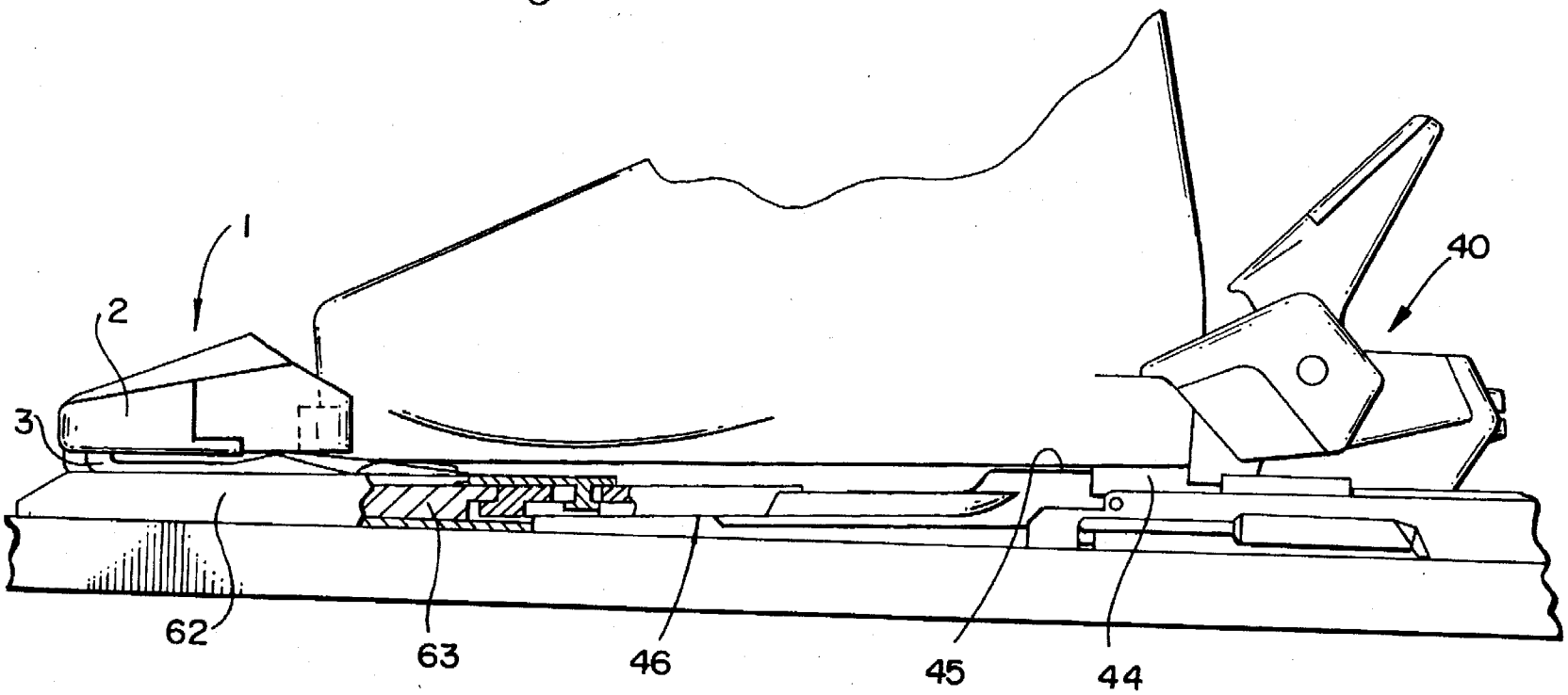
FIG. 5 is a view similar to FIG. 1, in the presence of the boot.

FIG. 1 represents the median portion of a ski which is equipped with a front binding element and a rear binding element.

Front binding element 1 represented in the embodiment of FIGS. 1 through 6 is known, for the most part, from French Patent Publication No. 2,640,516.

It comprises a body 2 connected to a base 3 which is fixedly connected to the ski by any appropriate means, and for example, by screws. Seen in a top view, the base has a "U" shape, open towards the rear, with two lateral arms 3*a* and 3*b*.

The body is vertically mobile with respect to the base, for example, by a deformable connection, localized in zone 9 at the junction between the body and the base. The body and the base are connected continuously by this deformable zone and form an integral element.

Body 2 bears a jaw 4 that retains the front end of the boot. Jaw 4 includes two lateral retention wings 5 and 6, respectively journaled to body 2 about axes 7 and 8. Jaw 4 also includes a sole-tightener 12 for the vertical retention of the boot.

Wings 5 and 6 are movable in response to the biases of the boot, against the return force that is applied to them by a spring 15.

Spring 15 is housed in the body. It activates a piston 16 that is also housed and guided in the body in a longitudinal translational movement. The drawings show that the piston is housed and guided in a housing 17 of the body and that the spring is engaged inside the piston. Its front end is in support against the base of the piston, located on the front side of the binding element. A screw 20 whose head is retained at the front of the body moreover extends through the piston and the spring, and at the rear has a nut 21 that retains the rear end of the spring. A rotation of the screw displaces the rear end of spring 15, which enables the initial compression of the spring to be adjusted.

Beyond their journal axles 7 and 8 to the body, wings 5 and 6 have a small arm 5*a* and 6*a*, that drives piston 16 towards the rear by taking support against a shoulder 23 located at the rear upper portion of piston 16.

In addition, binding element 1 includes a support device for the front end of the sole of the boot.

The support device has a support plate 25 on which the sole of the boot rests. In its upper portion, plate 25 can be equipped with any appropriate coating adapted to facilitate the lateral sliding of the boot, for example, a pad made of PTFE (polytetrafluroethylene). Its width is approximately as wide as the ski at this point. In the embodiment illustrated, plate 25 is journaled about a pin or axle extending along a transverse axis 26, that is borne by a bearing affixed to base 3 or fixedly connected to the ski.

Element 1 represented in the embodiment of FIGS. 1 through 7 has, in addition, a compensation mechanism that tempers the return force that spring 15 exerts on wings 5 and 6.

This mechanism includes a rocking element 30 that is partially housed between arms 3*a* and 3*b* of base 3. The rocking element is journaled about a pin or axle 32 borne by these arms.

Rocking element 30 has an approximately horizontal wing 33 that is accessible from the rear of the binding element between arms 3*a* and 3*b* of the base. The front of plate 25 is configured to rest on the end of arm 33.

In addition, rocking element 30 has an approximately vertical arm formed by two lateral skids that pass on each side of piston 16 and that each bear on a shoulder 37 that the piston has beneath shoulder 23 of the wings. Only skid 35 is visible in FIGS. 3 and 4.

Advantageously, a spring 38 returns plate 25 in a resting position that places its front end above wing 33 of the rocking element. When the boot is engaged, the plate becomes lowered until it comes into contact with arm 33. Thus, an automatic adaptation of the binding element to the thickness of the sole of the boot is obtained.

The dimensions of the rocking element are such that a downward vertical force exerted on its arm 33 is transmitted to piston 16 in the form of a rearward bias, that is to say, in the same direction as the biases originating from the wings. The rearward displacement of piston 16 is accompanied by a rotation of rocking element 30 about axle 32. The bias transmitted by the rocking element to piston 17 decreases by as much the force that one of the wings must itself exert on the piston in order to displace it sufficiently towards the rear so that the opening of the wing allows the release of the wing.

This mechanism compensates for the increase in friction between the sole of the boot and support plate 25 in case of a frontward fall.

A connecting rod moreover connects the rocking element at the front of axle 32 to the upper portion of the body. In case of a rearward fall, body 2 becomes raised by the deformation of zone 9. This movement is transmitted to the rocking element by connecting rod 39. This causes a bias on the piston, which occurs in the same direction as the previous bias. The increase in friction between the boot and the sole-tightener is thus compensated. If the bias of the sole is strong enough, the sole-tightener lets the sole of the boot escape upwardly.

Other compensation or adaptation mechanisms to the thickness of the sole can be utilized.

In addition, the construction of the binding element is not limiting in itself. It shows a construction method for the binding element with which the present invention is compatible. Other constructions can suffice, especially other simplified constructions.

The assembly represented in FIG. 1 also has a rear binding element 40. This element is of a known type. It especially has a movable jaw 41 borne by a body 42. Also in a known manner, body 42 is mobile along a slide 43.

The binding assembly also has a support plate 44 for the rear of the sole of the boot that is located in front of slide 43.

The device according to the invention has a sensor capable of capturing the biases of the boot.

In addition, there is a connection between the sensor and the front binding element. This connection includes an assembly of structural elements provided to increase the return force that the spring provides against the opening of a wing, with the intensity of the bias captured by the sensor.

In the embodiment illustrated, the sensor is support plate 44 located in front of slide 43. The connection between the sensor and the front element comprises a plate 46 whose front end is connected to the front binding element, and whose rear end is movable. The rear end has a support plate 45 on which the boot rests, the support plate 45 being brought to the level of support plate 44 in the presence of the boot. This is visible in FIG. 5. As represented, plate 46 could be made of two portions that are assembled to each other, so as to adapt the length of the plate to the spacing of the front and rear binding elements.

In addition, the slide is connected to the ski by a base plate 48 to which it is journaled about a transverse axis 49. The transverse axis is materialized by the cooperation of the rear end of the slide with the rear edge of the base plate. A journal axle formed by a pin or any other appropriate means can also suffice. Preferably, the connection between the slide and the base is provided to enable the front end of the slide to be lowered vertically, and to prevent the rocking movements between the slide and the base, so as to enable a vertical suspension of the boot while retaining a good transmission of lateral forces, especially during edge gripping of the ski.

A block of shock-absorbing material 50 located between the slide and the base plate elastically returns slide 43 upwardly, against an abutment 51, for example affixed to the base plate. Block 50 can be replaced by any appropriate means, for example, a spring.

The slide can thus oscillate vertically downwardly from the position defined by abutment 51, against the return force of block 50. In particular, when plate 46 is in the position of FIG. 6, the slide can oscillate downwardly under the impetus of the biases of the boot. Support plate 44 then forms a sensor that captures the vertical biases of the boot or, more precisely, the variations of the support force exerted by the rear end of the sole of the boot.

Figure 6:
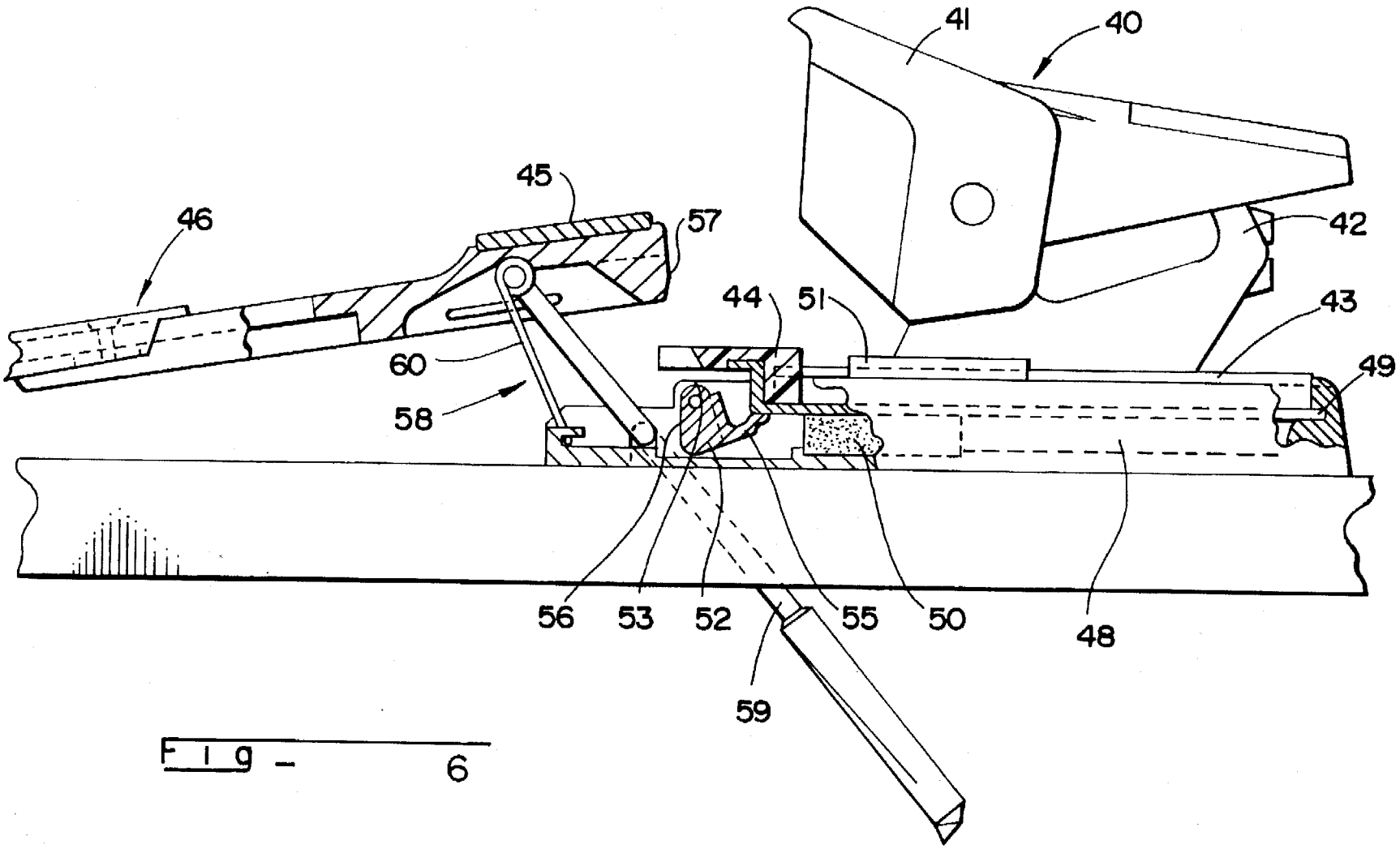
FIG. 6 represents a partial sectional side elevation view of the assembly of FIG. 1 in the area of the rear binding element.

FIG. 6 best illustrates the connection between plate 46 and slide 43. A rocking element 52 journaled about a transverse axle 53 borne by base 48 is located beneath support plate 44. The rocking element has a horizontal arm 55 engaged beneath the slide and, in addition, it has a substantially vertical support face 56 against which is brought a complementary face 57 located at the rear end of the plate, when the plate is in the lowered position.

In this way, the downward oscillation of the slide causes the rotation of the rocking element and the frontward movement of plate 46, by the support of rocking element 52 on the rear face 57 of the plate.

Plate 46 is preferably connected to the front by a journal, and in the area of its rear end, it is biased upwardly by a device forming a ski brake 58. It is to be noted that this device includes two journaled arms 59 that are returned by a spring 60.

As for the front binding element, it is mounted on a base plate 62 that is fixedly connected to the ski. The base plate extends between the base and the ski. It is provided with a longitudinal housing within which a slide 63 is guided. The slide ends at the rear of the base plate and it is connected to the front of plate 46 by a cooperation of shapes enabling the journal to be obtained.

Moreover, the connection is ensured by a flexible tongue 64, each of whose ends is respectively affixed to the base plate and to the plate. Any other connection means can also suffice.

At the front, the slide 63 is in support against the lower end of a lever 66. This element penetrates inside body 3 by a vertical housing 67 located at the front, its upper flared portion is crossed by screw 20 and takes support beneath its head. Its upper end rests on the body beyond the screw. Due to the action of slide 63, lever 66 acts on the screw head in the manner of a lever, by taking support on body 2. At rest, the screw head presses lever 66 against the wall of housing 67.

A longitudinal displacement of the slide due to the progression of plate 46 causes a rocking of the lever 66 which acts on the screw 20 by forcing it to be translated towards the front. This results in an additional compression of the spring that strengthens the resistance opposed to the opening of the wings. This resistance is thus relatively weak when skiing pace is normal, i.e., at rest or at slow speeds. When the skier skis more quickly, the support force variations on sensor 44 are transmitted to spring 15 that momentarily induces a greater return force on the wings.

The ratio of the respective length of the lever arm with which lever 66 acts on spring 15 can naturally be adjusted by the relative height of the various elements.

It must be noted that the different movements of the plate and of the slide are returned elastically by the additional compression that they induce on spring 15.

In addition, the action of the slide on the spring does not affect the functioning of the compensation mechanisms. Such mechanisms are only affected by the additional compression of the spring. These mechanisms can thus function normally, their effect becoming superposed to the compression variation of the spring that is caused by lever 66.

Figure 8:
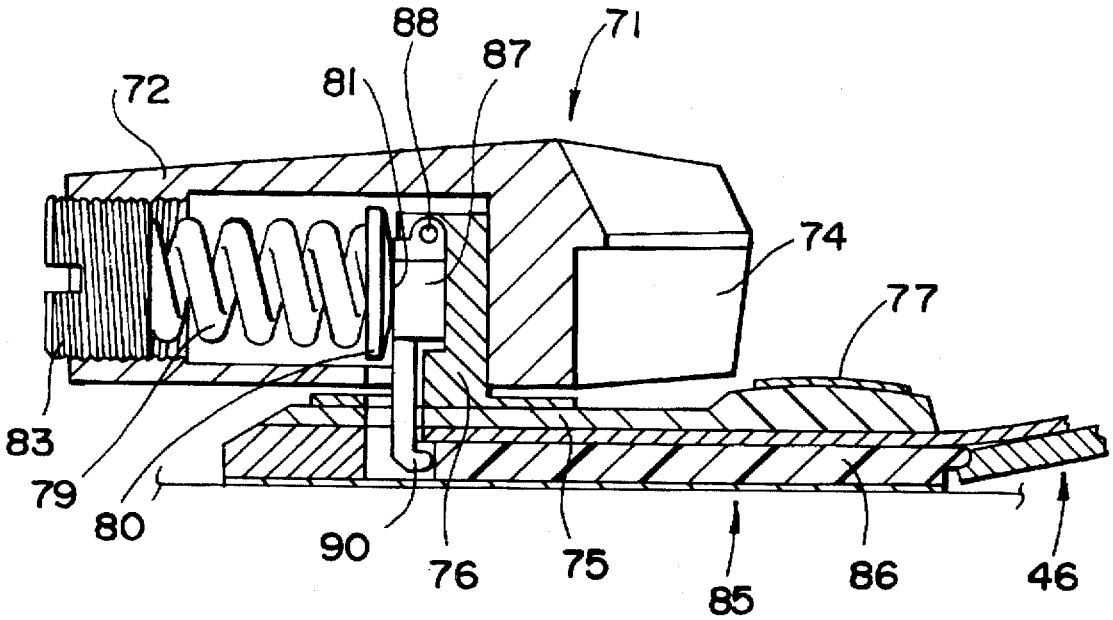
FIG. 8 is related to another embodiment of the front binding element.
Figure 9:
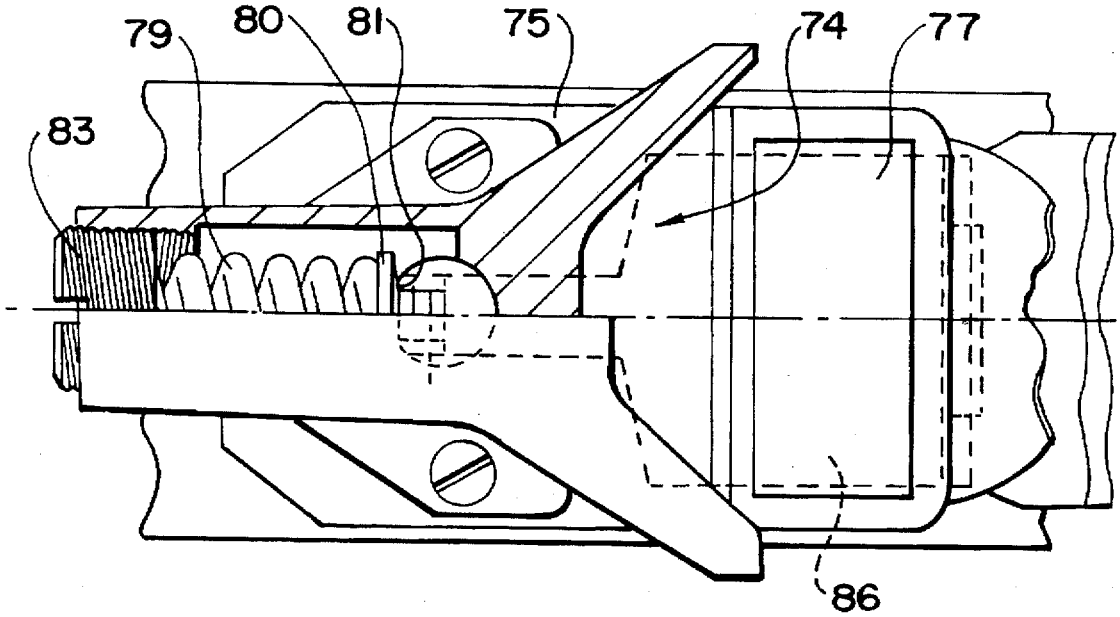
FIG. 9 represents in a top plan view, in two half sections along different planes, the binding element of FIG. 8.
Figure 10:
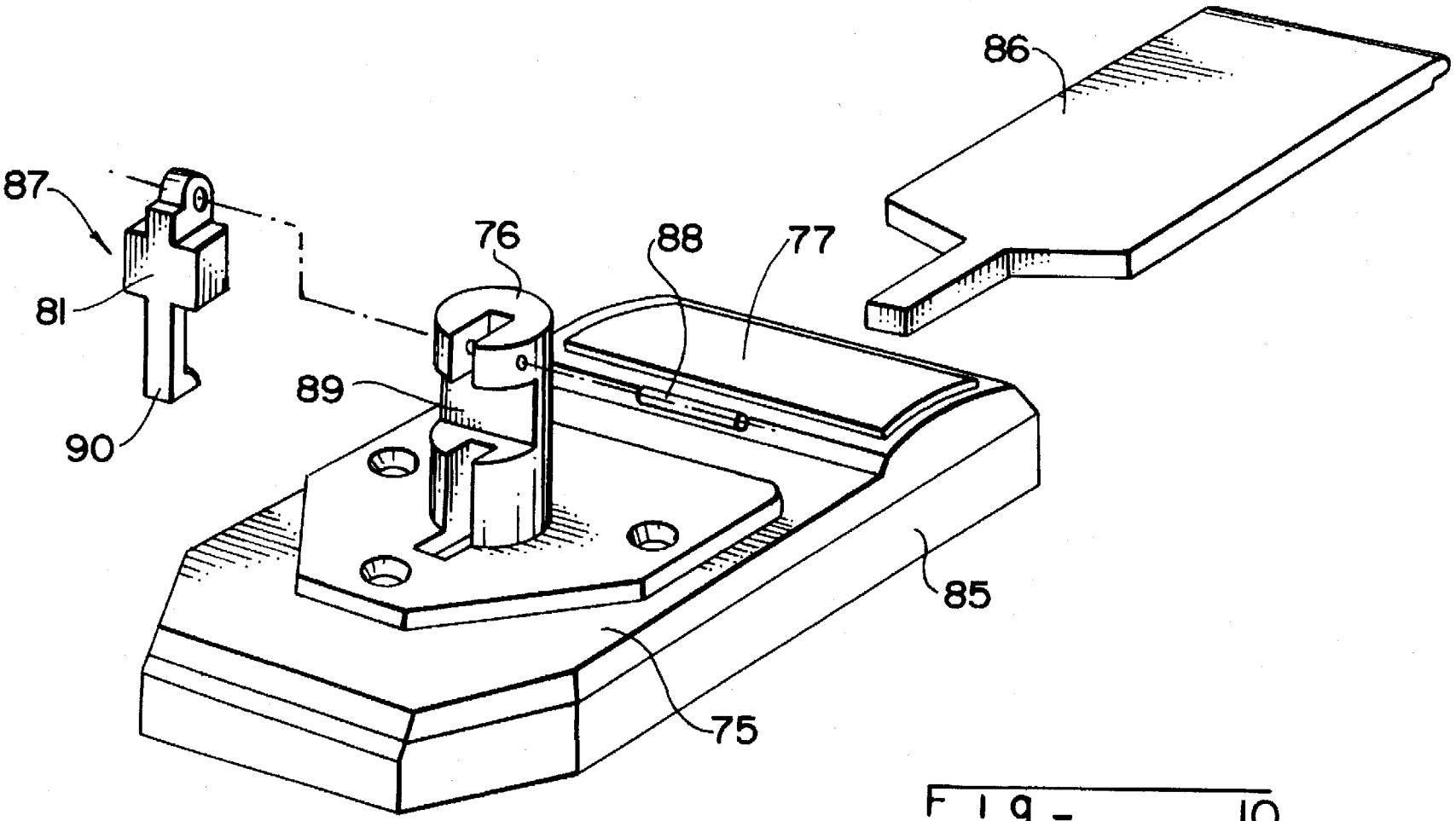
FIG. 10 represents an exploded perspective view of the base of the binding element of FIG. 7.

FIGS. 8 through 10 are related to a further embodiment of the front binding element. Binding element 71 is of the rotating body type. It has a jaw 74 fixedly connected to a body 72. The body is pivotally mounted about a pivot 76 borne by a base 75. The base is extended towards the front by a support plate 77 adapted to receive the sole of the boot.

In a known manner, jaw 74 is made of a single element and has two lateral retention wings and a vertical retention sole tightener.

A spring 79 is housed in the body, the spring pushing a joining piece element 80 against a flat surface 81 located at the front of pivot 76. Spring 79 is placed under pre-stress by a stopper 83 screwed on the front of the body.

Base 75 is installed on a base plate 85, bored with a longitudinal housing in which a slide 86 is guided. Towards the rear, the slide is connected to plate 46, for example by the same means as those that have been described previously.

At the front, slide 86 takes support against a flap 87 journaled in its upper portion about a transverse pin 88 borne by pivot 76. Flap 87 is embedded in a housing 89 located at the front of the pivot, and it has, on its front face, flat surface 81 against which joining piece element 80 takes support. At rest, flap 87 is in support at the base of its housing 89, under the thrust of spring 79.

Towards the base, the flap has a foot 90 that crosses base 75 and ends in the housing of base plate 85. The slide 86 acts on foot 90 by pushing it back towards the front.

Binding element 71 is associated to a movable sensor adapted to catch the biases of the boot. For example, this sensor is associated to a rear binding element and a plate of the same type as those that have been described previously.

The assembly functions as follows. When the sensor captures a vertical bias of the boot, it causes a frontward movement of the plate and the slide, in turn causing a pivoting of flap 87. This pivoting momentarily increases the pre-stress of spring 79. As such, body 72 will encounter a momentarily greater resistance force that resists its pivoting about pivot 76.

It must be emphasized that the movement of the flap, of slide 86 and of plate 46 are elastically returned by the additional compression of spring 79.

Figure 11:
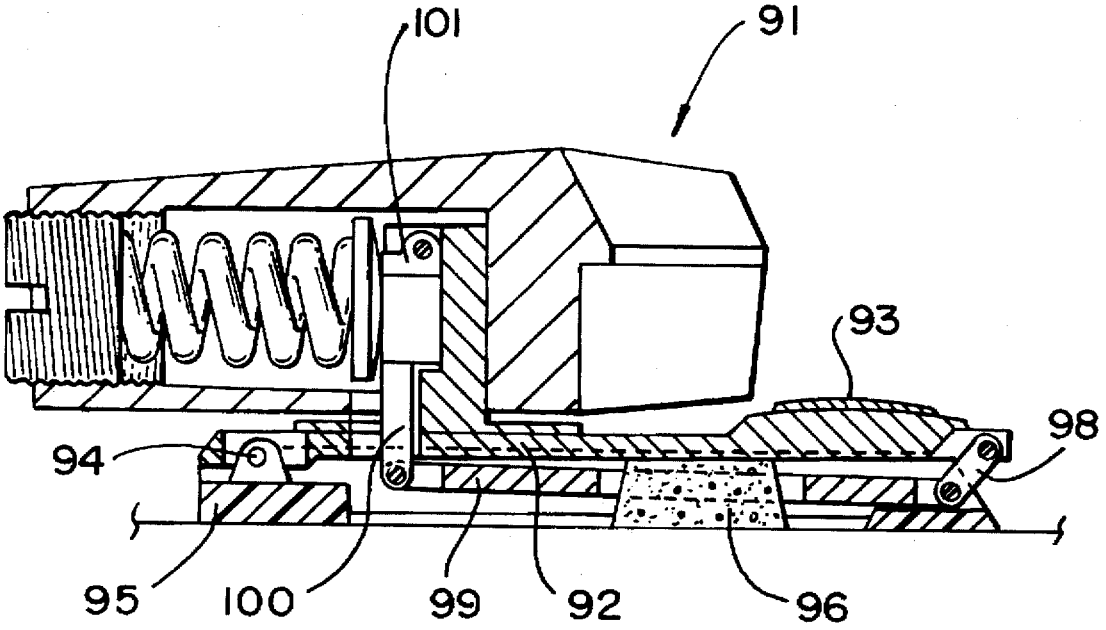
FIG. 11 represents yet another embodiment of the invention.

FIG. 11 illustrates an additional variation. It represents a binding element 91 whose construction is similar to that of preceding element 71.

The main difference is that here the sensor is formed by front support plate 93. Base 92 of element 91 bears this support plate at the rear. At the front, the base is connected to a journal axis 94 borne by a bearing 95 that is affixed to the ski.

The base is maintained raised by a block 96 of an elastically deformable material.

It is also maintained by an assembly of two connection rods 98 and 99 that are journaled with respect to one another. Connection rod 98 has a small length and is connected to the rear end of the base at one of its ends. Its other end rests on the upper surface of the ski, by means of a plug 99 affixed to the ski, or by any other appropriate means.

The other connection rod connects the lower end of connection rod 98 to foot 100 of flap 101 embedded in the pivot.

While skiing at a normal pace, the rear portion of base 92 is maintained suspended above the ski. In case of excessive bias, this portion becomes lowered which causes the frontward rocking of the flap by the play of the connection rods, in turn causing an additional compression.

Thus, the binding element has a stiffness that varies with the biases of the boot. Initially, the stiffness can be adjusted to a low value. This provides the skier with good safety in case of a fall while at rest or at low speeds. Indeed, it is known that falls at rest or at slow speeds are relatively more serious than those at high speeds, especially torsional or pre-torsional falls.

While skiing, the stiffness increases with the biases that transit between the boot and the ski. As such, the boot is held better on the ski in the propulsion and turn execution phases, in other words, at those moments when the skier exerts substantial support on his or her ski, where it is required that the ski provide solid support on the snow, in situations where the skier is not really in any danger.

The stiffness of the binding element automatically returns to its initial value as soon as the skier exerts less bias on the ski.

It must be noted that the action of the sensor on the compression of the spring can also induce an effect on the bending of the ski. Thus, in the first two embodiments described in FIGS. 1 through 10, sensor 44, rocking element 52 and plate 46 all play a role on the bending of the ski that is similar to the one for the elements described in European Patent Publication No. 567 780. The variations in support of the boot on the sensor produce the same effect on the front end of the ski, i.e., a bending moment tending to make the front of the ski plunge towards the snow. The intensity of this moment depends mainly on the height of the journal between plate 46 and slide 63 (or 86) with respect to the upper surface of the ski, and on the height of the point of support of slide 63 (or 86) on lever 66 or flap 87.

The valve role played by the pre-stressed spring is ensured here by the return spring of the wings (that is, spring 15 or spring 79). This is such that under the effect of strong support vibrations from the skier, or substantial bending of the ski, spring 15 or 79, while becoming compressed, not only increases the stiffness of the binding element, but also protects the sensor mechanism, especially rocking element 52, against excessive biases.

Spring 15 or 79 can only become additionally compressed under the effect of a bias that is greater than its initial pre-stress, in the same way as the spring of the valve.

If the bias that the sensor transmits to the plate remains on this side of the pre-stress of the spring, it is directly transmitted to the ski in the form of a bending moment in the same way as is described in European Patent Publication No. 567 780.

Generally speaking, the two effects, i.e., bending of the ski and increase in stiffness, are produced together.

The construction described with respect to FIG. 11 also exerts an effect on the bending of the ski, but this effect is inverted, i.e., it tends to raise the front of the ski.

Indeed, a bias exerted on the sensor tends, by reaction, to pull base 92 of the binding towards the rear. This reaction is transmitted to axle 94 and is transformed at this level into a bending moment that tends to raise the front of the ski.

The invention is not limited to the various constructions that have been described, and it encompasses all variations, equivalents, and generally speaking, all constructions that are defined by the annexed claims.

In particular, the invention is not limited to a front binding element. It is also related to a binding element of the rear type whose return spring could be compressed additionally by the action of a sensor located preferably beneath the front end of the sole, in the manner of sensor 93.

In addition, the sensor could be independent, i.e., dissociated from the base of the binding element to which it is associated.

The movement of the sensor is not necessarily vertical. The sensor could also capture the rocking biases of the front or rear end of the boot.

The instant application is based upon French patent application 94.04051 of Mar. 30, 1994, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A retention element adapted to retain an end of a boot on a gliding board, said retention element comprising:

a base adapted to be affixed to the gliding board;

a body mounted to said base;

a retention jaw carried by said body, said jaw adapted to engage the end of the boot, said retention jaw being mounted for movement with respect to the base between a boot retention position and a boot release position;

a retention jaw return mechanism comprising an elastic return spring and a latching member, said elastic return spring being positioned to exert an elastic return force against said latching member, said latching member being positioned to transfer said elastic return force in opposition to movement of said retention jaw to said boot release position;

a sensor adapted to be engaged by at least a portion of a sole of the boot; and a connection between said sensor and said return mechanism, said connection including an assembly of structural elements positioned between said sensor and said return mechanism to increase said elastic return force exerted on said retention jaw in response to an increased support force exerted on said sensor.

2. A retention element according to claim 1, wherein:

the retention element is a front binding and has a structure adapted to engage a front end of the boot.

3. A retention element according to claim 2, wherein:

said return mechanism includes an adjustment screw positioned to enable a pre-stress of said return spring to be adjusted; and said connection includes a lever connected to said adjustment screw, said lever being positioned to exert a force to said adjustment screw to compress said return spring additionally to said pre-stress.

4. A retention element according to claim 1, wherein:

said base includes an upwardly projecting pivot, said body being mounted to move about said pivot;

a flap having a flat surface is mounted to move with respect to said pivot;

said latching member is a joining element, said joining element being in engagement with said flat surface of said flap; and said structural elements of said connection include an element in engagement with said flap to exert a force to said adjustment screw to compress said return spring additionally to said pre-stress.

5. A retention element according to claim 1, wherein:

said sensor is adapted to support a rear end of the boot.

6. A retention element according to claim 5, wherein:

said connection further includes:

a longitudinally extending plate, said sensor comprising a rear end portion of said plate, said rear end portion of said plate being mounted for movement in a vertical plane;

a slide adapted to move longitudinally with respect to the gliding board, a front end of said longitudinally extending plate being pivotally connected to said slide; and a rocking element mounted for rocking movement, said rocking element being in engagement with said longitudinally extending plate for longitudinally translating said plate and said slide in response to a downward movement of said rear end portion of said plate.

7. A retention element according to claim 1, wherein:

said sensor is adapted to support a front end of the boot and is mounted to said base of the retention element.

8. A retention assembly adapted to retain a boot upon a gliding board, said assembly comprising a front retention element and a rear retention element, one of said front retention element and said rear retention element comprises a retention element according to claim 1.

9. A retention assembly adapted to retain a boot upon an alpine ski, said assembly comprising a front retention element and a rear retention element, one of said front retention element and said rear retention element comprises a retention element according to claim 1.

10. A retention element adapted to retain an end of a boot on a gliding board, said retention element comprising:

a retention jaw adapted to engage the end of the boot;

means mounting said retention jaw for movement with respect to the gliding board between a boot retention position and a boot release position;

means for exerting an elastic return force to said retention jaw in opposition to said movement of said retention jaw to said boot release position;

a sensor adapted to be engaged by at least a portion of a sole of the boot; and a connection between said sensor and said means for exerting an elastic return force to said retention jaw, said connection comprising means for increasing said elastic return force exerted on said retention jaw in response to an increased support force exerted on said sensor.

* * * * *